US006021902A

United States Patent [19]

Wu

[11] Patent Number: 6,021,902

[45] Date of Patent: Feb. 8, 2000

[54] MODULAR MEDICINE CONTAINER WITH MEANS FOR REMINDING A USER OF TIME TO TAKE MEDICINES

[75] Inventor: Hsi-Chuan Wu, Taipei, Taiwan

[73] Assignee: Well-Bred Horse Co., Ltd., Taipei, Taiwan

[21] Appl. No.: 09/296,431

[22] Filed: Apr. 23, 1999

[51] Int. Cl.[7] ..... B65D 21/00; B65D 83/04

[52] U.S. Cl. ..... 206/534; 206/459.1

[58] Field of Search ..... 206/534, 538, 206/459.5, 459.1, 828, 570; 220/23.83

[56] References Cited

U.S. PATENT DOCUMENTS 5,181,189 1/1993 Hafner ..... 206/534 X
5,299,711 4/1994 Romick ..... 206/534 X

*Primary Examiner*—Jacob K. Ackun
*Attorney, Agent, or Firm*—Rosenberg, Klein & Lee

[57] ABSTRACT

A modular medicine container with means for reminding a user of time to take medicines mainly includes a cover and at least one case having a plurality of compartments. The cover and the at least one case are slidable relative to one another to open or close the compartments one by one. Different designs symbolizing particular times are provided on front wall surfaces of the compartments as a reminder of time to take the medicines in the compartments. The cover is provide with a timing circuit, a plurality of keys for setting times of taking medicines, a display, and a sound generator for giving a warning sound each time a preset time of taking medicines is reached. The medicine container may be conveniently carried and is capable of reminding a user to take prescribed medicines at specified times.

3 Claims, 4 Drawing Sheets

MODULAR MEDICINE CONTAINER WITH MEANS FOR REMINDING A USER OF TIME TO TAKE MEDICINES

BACKGROUND OF THE INVENTION

The present invention relates to a medicine container, and more particularly to a modular medicine container with means for reminding a user of time to take medicines.

When a doctor prescribes for a patient, the prescribed medicines usually include more than one type of medicine to be taken at specified times, such as in the morning, at noon, in the evening, etc. However, many patients often forget to take the prescribed medicines at the specified times. It is therefore desirable to have a medicine container that is convenient for carrying and is designed to hold different medicines to avoid possible mistake of taking wrong medicines at wrong time. Taiwanese Utility Model Patent No. 85216667 discloses a modular medicine container that includes modular cases for holding and keeping medicines in order. However, the medicine container has not the function of reminding a user of time to take the medicines.

SUMMARY OF THE INVENTION

It is therefore a primary object of the present invention to provide a modular medicine container having means for reminding a user of time to take medicines. To achieve this object, the medicine container of the present invention mainly includes a cover and at least one case having a plurality of compartments for containing medicines. The cover and the at least one case are provided with means to enable them slidably movable relative to one another, in order to open or close the compartments one by one. Different designs symbolizing particular times are provided on front wall surfaces of the compartments as a reminder of time to take the medicines in the compartments. The cover is provided with a timing circuit, a plurality of keys for setting times of taking medicines, a display, and a sound generator for giving a warning sound each time a preset time of taking medicines is reached.

BRIEF DESCRIPTION OF THE DRAWINGS

The features and the novelty of the present invention may be best understood by referring to the following detailed description of the preferred embodiments and the accompanying drawings, wherein.

DETAILED DESCRIPTION OF THE PREFERRED EMBODIMENTS

Figure 1:
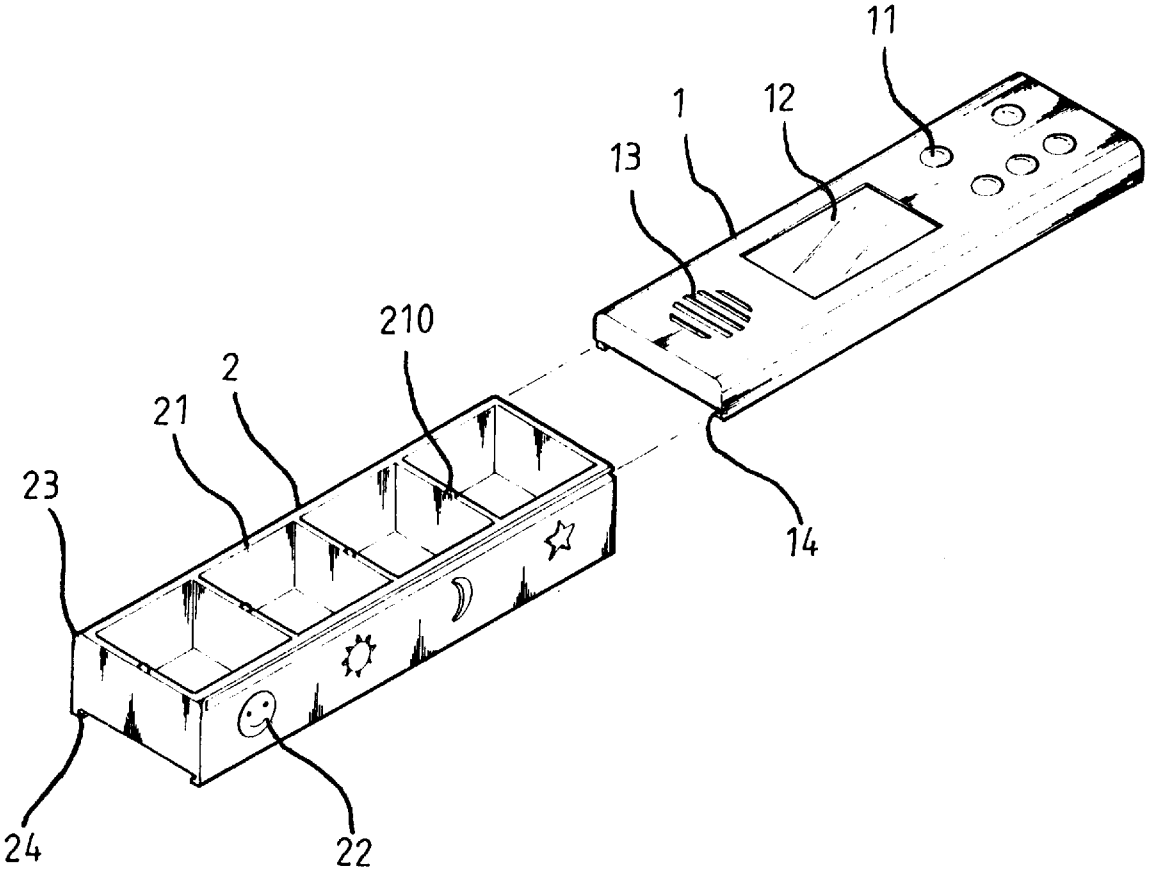
FIG. 1 is an exploded perspective showing the manner in which a cover and a case of the modular medicine container of the present invention are assembled.

Please refer to FIG. 1. The present invention relates to a medicine container including a cover 1 and at least a case 2. The cover 1 is provided at inner side with a timing circuit (not shown) and at a top surface with a plurality of keys 11 for setting different times of taking medicines, a display 12, and a sound generator 13 for giving a warning sound each time a preset time of taking medicines is reached. The cover 1 is formed along its two longitudinal lower edges with first retaining means 14.

The case 2 defines a space that is divided by partitions into a plurality of compartments 21. Different designs 22 are provided on a front wall surface of the case 2 corresponding to each compartment 21. Each design 22 symbolizes a time on which one or more types of medicines contained in the compartment 21 corresponding to the design 22 should be taken. The case 2 is formed along its two longitudinal upper edges with sliding grooves 23. The sliding grooves 23 engage with the first retaining means 14 of the cover 1, so that the cover 1 may be slidably moved along the sliding grooves 23 relative to the case 2 to close or open the compartments 21.

Figure 2:
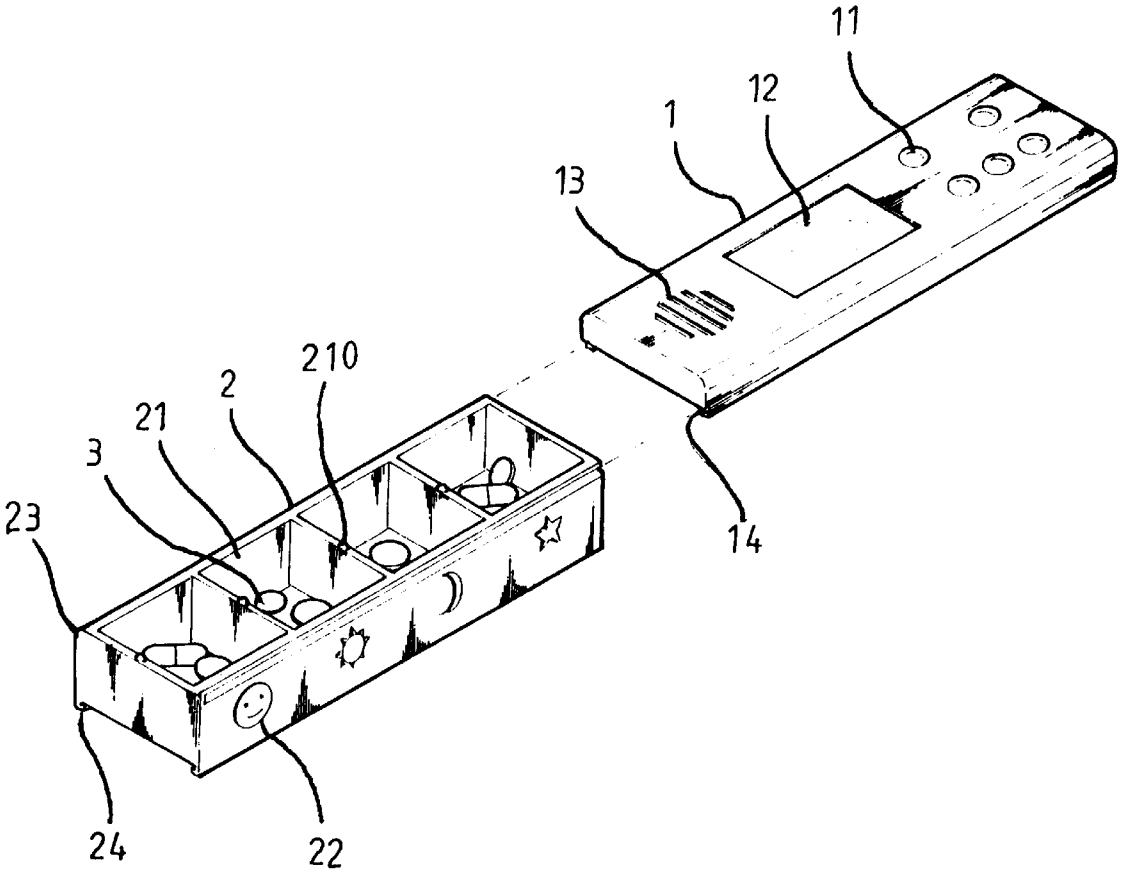
FIG. 2 is a perspective showing the medicine container of the present invention being used to contain medicines to be taken at different times.

FIG. 2 illustrates the medicine container of the present invention in use. Medicines 3 to be taken at specified times are separately dispensed into compartments 21 of the case 2 corresponding to the designs 22 symbolizing the times to take the medicines. The case 2 is then closed with the cover 1 by engaging the sliding grooves 23 with the first retaining means 14 and pushing the cover 1 along the sliding grooves 23 until the case 2 is fully closed. Thereafter, the times specified to take the medicines 3 are set via the timing circuit and the keys 11 on the cover 1, so that the sound generator 13 gives a warning sound at each preset time to remind the user to take the medicines 3. At this point, the user may slide the cover 1 along the sliding grooves 23 of the case 2 until the compartment 21 having the design 22 similarly indicating the preset time is opened. With these arrangements, the user would not carelessly forget the time of taking medicines or wrongly take incorrect medicines that should not be taken at that time.

Figure 3:
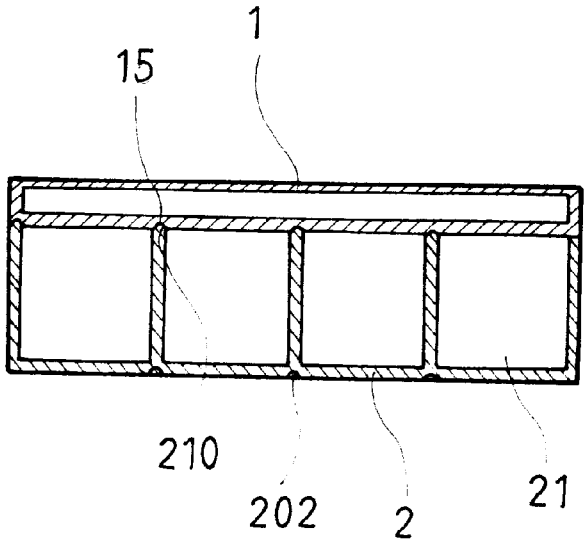
FIG. 3 shows the manner in which the cover is moved to close and open the case of the medicine container.
Figure 3:
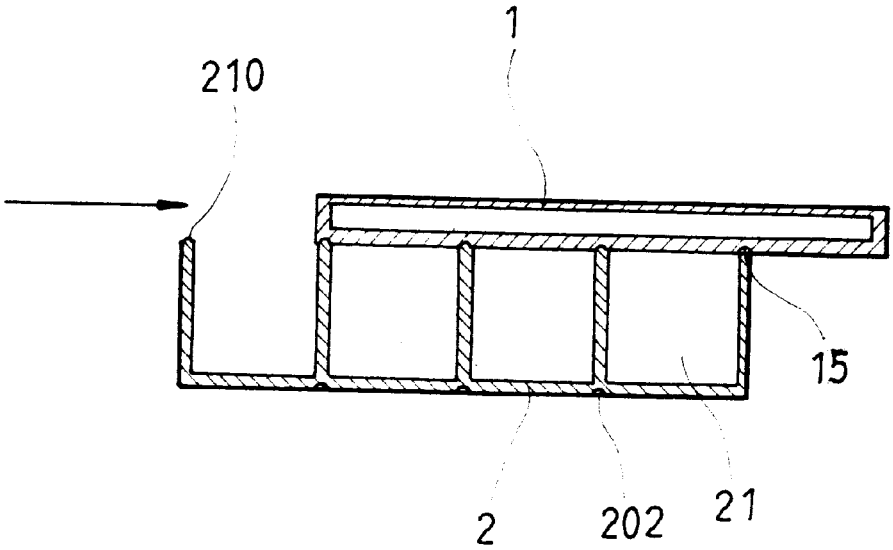

Please refer to FIG. 3. The case 2 is provided at top centers of the partitions between any two adjacent compartments 21 with a protuberance 210 each, and at a bottom surface of the case 2 at positions corresponding to the protuberances 210 on the partitions with first recesses 202. Meanwhile, the cover 1 is provided at its lower surfaces contacting with the case 2 with a plurality of second recesses 15 separately corresponding to the protuberances 210 on tops of the partitions of the compartments 21. Whereby when the cover 1 is slid along the sliding grooves 23 to open the case 2, the second recesses 15 shall engage with the protuberances 210 whenever the cover 1 is moved to open one full compartment 21. The engagement of the second recesses 15 with the protuberances 210 allows the cover 1 to move step by step and open the compartments 21 one by one. This structure is particularly helpful when the medicine container is carried for use outdoors, because the medicine container is prevented from the risk of turnover when it is being opened and thereby causes undesired dropping, mixing or missing of the medicines 3 dispensed into the compartments 21.

Figure 4:
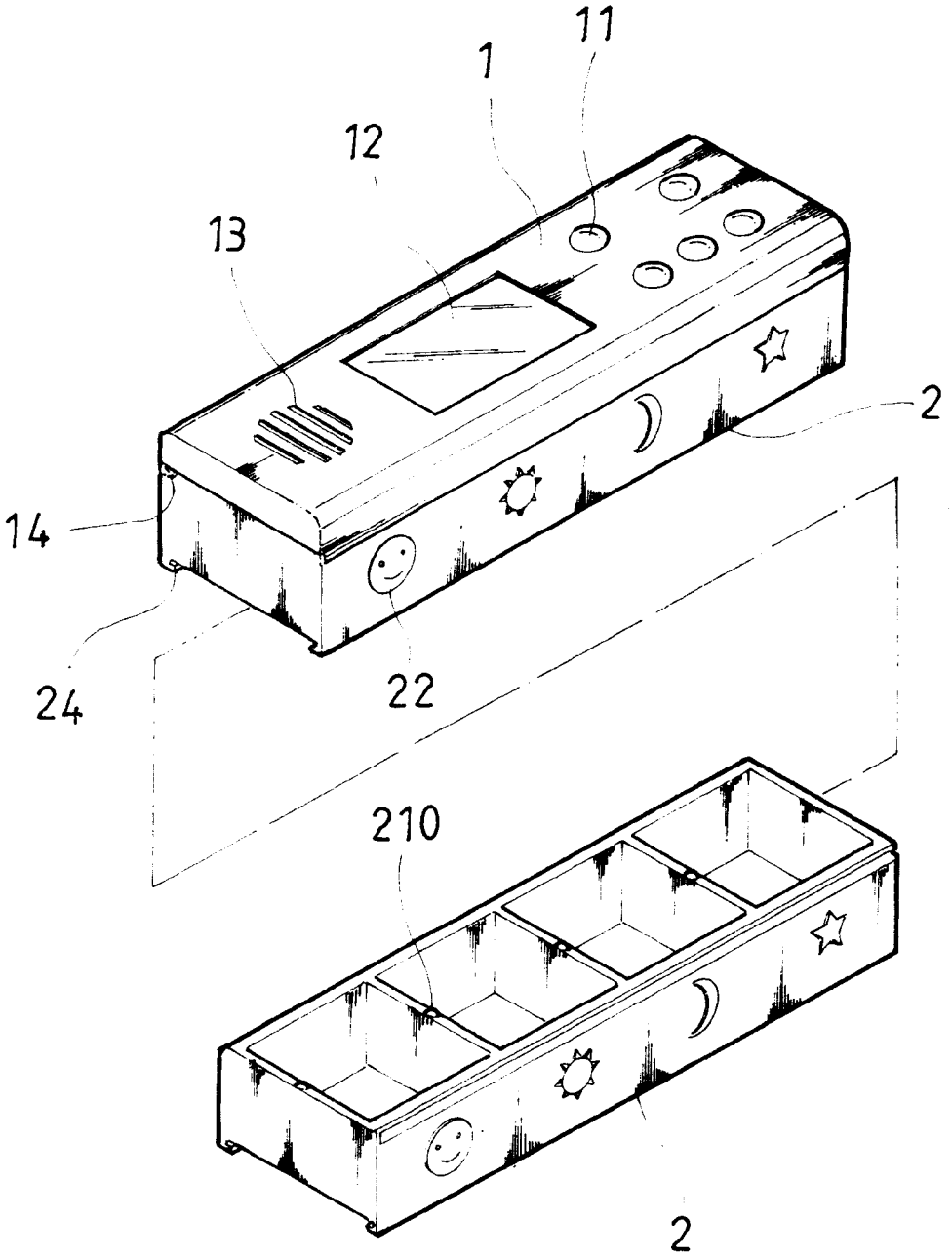
FIG. 4 shows the manner in which more than one case is attached to the cover of the medicine container of the present invention.

As shown in FIG. 4, the medicine container of the present invention may include more than one case 2 simply by providing second retaining means 24 along two longitudinal lower edges of the case 2 corresponding to the sliding grooves 23. A second case 2 may be easily connected to and below a first case 2 by engaging the sliding grooves 23 of the second case 2 with the second retaining means 24 of the first case 2. The first case 2 may be slid along the sliding grooves 23 of the second case 2 to open the compartments 21 of the second case 2 one by one, just in the same manner as moving the cover 1 to open the first case 2. By this way, the medicine container provides more compartments 21 for medicines 3 for more days.

With the above arrangements, the medicine container according to the present invention has simple but practical structure to effectively remind a user to take prescribed medicines at specified time without the risk of making mistakes in taking incorrect medicines at incorrect time.

What is claimed is:

1. A modular medicine container with means for reminding a user of time to take medicines, comprising a cover and at least one case connected to a bottom of said cover, said cover being provided along two longitudinal lower edges with first retaining means, and said case each being provided along two longitudinal upper edges with sliding grooves for engaging with said first retaining means of said cover and along two longitudinal lower edges with second retaining means for engaging with said sliding grooves of another said case, said case each defining a space in which partitions are provided to divide said space into a plurality of compartments into which medicines are dispensed; said medicine container being characterized in that said cover is provided with a timing circuit for setting times to take said medicines, and that said case each is provided at front wall surfaces of said compartments with designs symbolizing different times to remind a user of taking said medicines contained in each said compartment at a time symbolized by said design in front of said compartment.

2. A modular medicine container with means for reminding a user of time to take medicines as claimed in claim 1, wherein said case is provided at top centers of said partitions between any two adjacent compartments with a protuberance each, and said cover being provided at a lower surface contacting with said case with a plurality of first recesses separately corresponding to said protuberances on said partitions of said compartments, whereby when said cover is slid along said sliding grooves to open said case, said recesses engage with said protuberances whenever said cover is moved to fully open one of said compartments, and said engagement of said recesses with said protuberances allowing said cover to move step by step and open said compartments one by one.

3. A modular medicine container with means for reminding a user of time to take medicines as claimed in claim 1, wherein said at least one case each is provided on a bottom surface at positions corresponding to said protuberances on said partitions with second recesses for engaging with said protuberances on another said case, whereby one of said at least one case at an upper position can be slidably moved relative to another said case at a lower position step by step and open said compartments of said lower case one by one.

* * * * *